United States Patent [19]

Goodsell, Jr.

[11] 4,029,150

[45] June 14, 1977

[54] SPRINKLER

[75] Inventor: Earl M. Goodsell, Jr., Hudson, Ohio

[73] Assignee: A-T-O Inc., Willoughby, Ohio

[22] Filed: Mar. 5, 1976

[21] Appl. No.: 664,187

[52] U.S. Cl. ..... 169/39

[51] Int. Cl.[2] ..... A62C 37/08

[58] Field of Search ..... 169/37, 38, 39, 40, 169/42

[56] References Cited

UNITED STATES PATENTS

| | | | |
|---|---|---|---|
| 2,502,754 | 4/1950 | Rowley | 169/38 |
| 3,469,632 | 9/1969 | Ault | 169/39 |
| 3,498,383 | 3/1970 | Vorkapich | 169/39 |
| 3,625,289 | 12/1971 | Gloeckler | 169/39 |

*Primary Examiner*—Evon C. Blunk
*Assistant Examiner*—Michael Mar
*Attorney, Agent, or Firm*—Webster B. Harpman

[57] ABSTRACT

A sprinkler for use in a fire extinguishing system includes an apertured body member, a closure cap, a frame supporting a deflector, a strut holding the closure cap and a lever bearing against said strut and releasably retained by a transversely disposed fusible element engaging spaced apertured arms on said strut.

7 Claims, 5 Drawing Figures

SPRINKLER

BACKGROUND OF THE INVENTION

1. Field of the Invention

This invention relates to spinklers of the type normally employed in fire extinguishing sprinkler systems.

2. Description of the Prior Art

Sprinklers heretofore known in the art have utilized many variations of struts and levers engaged between the closure caps of the sprinklers and a portion of the frame opposite thereto. See for example U.S. Pat. Nos. 1,231,439 and 1,919,508 wherein fulcrumed levers with inter-engaging fusible elements are disclosed. Fusible elements acting to directly retain closure caps in sprinklers are seen in U.S. Pat. No. 1,945,450 and fusible elements combined with stuts and levers are disclosed in U.S. Pat. Nos. 2,165,477, 3,291,216 and 3,336,984. Sprinklers with horizontally disposed fusible elements arranged to retain strut and lever assemblies engaged against closure caps are seen in U.S. Pat. Nos. 2,502,754, 2,534,065 and 3,625,289.

This invention eliminates several production problems inherent in the manufacture and assembly of the prior art devices in forming the sprinkler so that it can be made and assembled by automatic machinery. The arrangement of the fusible element and its positioning between the apertured arms of the strut of the sprinkler where it effectively retains the lever avoids the alloy cold flow problems heretofore associated with fusible elements in fire extinguishing sprinklers.

SUMMARY OF THE INVENTION

A sprinkler having an apertured body defining a fluid delivering passageway normally closed by a closure cap includes a frame positioning a deflector in spaced opposed relation to the fluid passageway. A strut, lever and fusible element assembly is positioned between the deflector and the closure cap with the fusible element taking the form of a tubular member having spheres closing its ends and confining fusible material therebetween and the outer portions of the spheres engaging spaced apertured arms on the strut of the sprinkler so as to form an area therebetween in which a portion of the lever is located in engagement with the fusible element.

DESCRIPTION OF THE PREFERRED EMBODIMENT

Figure 1:
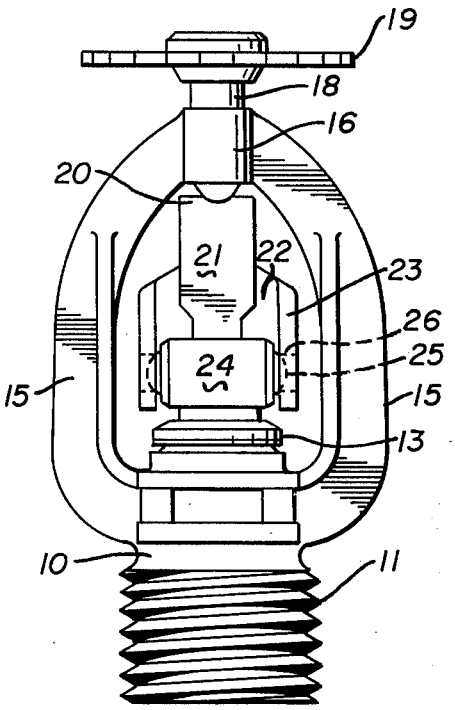
FIG. 1 is a side elevational view of a sprinkler embodying the present invention.
Figure 2:
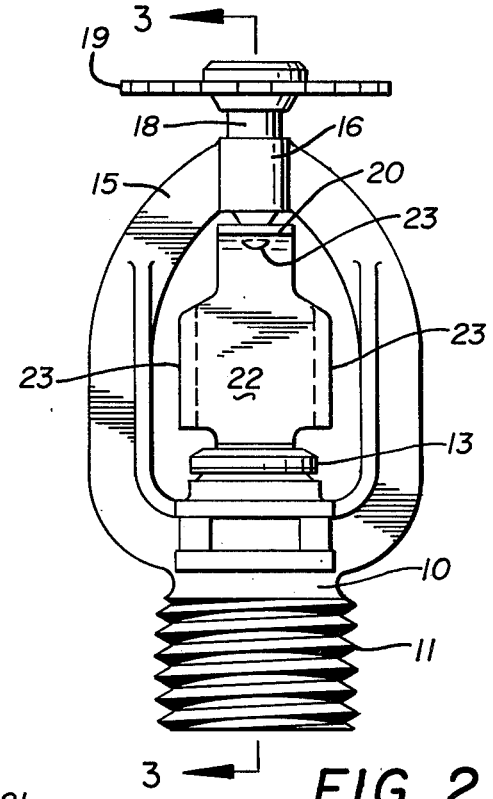
FIG. 2 is a view similar to FIG. 1 but taken from the opposite side.
Figure 3:
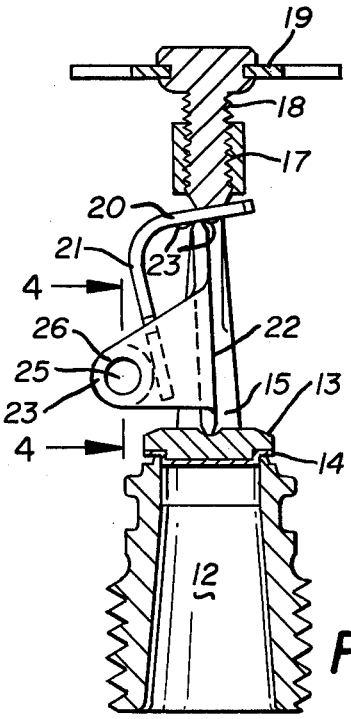
FIG. 3 is a vertical section on line 3—3 of FIG. 2.
Figure 5:
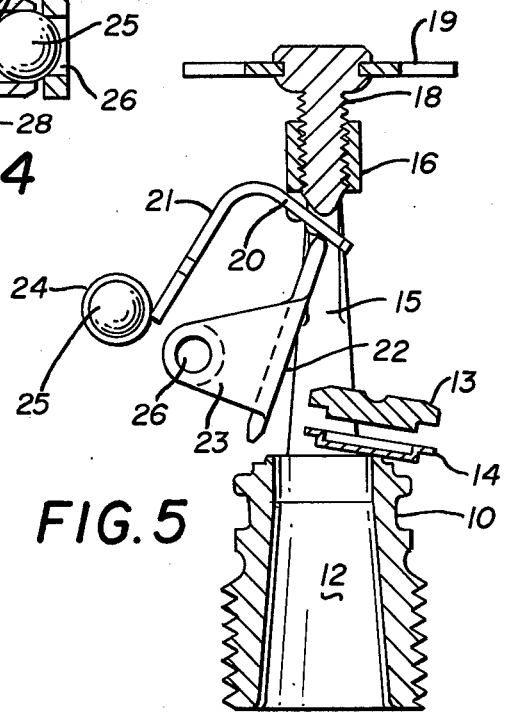
FIG. 5 is a view similar to FIG. 3 showing the sprinkler in opening position.

In the form of the invention chosen for illustration herein and as best seen in FIGS. 1, 2 and 3 of the drawings, the sprinkler comprises an apertured body member 10, the lower portion of which is externally threaded as at 11 so that it can be turned into a pipe fitting in a sprinkler system. The apertured body member 10 defines a fluid delivery passage 12 as seen in FIGS. 3 and 5 of the drawings and the discharge end thereof is normally closed by a closure cap 13 and gasket 14.

A frame formed of oppositely disposed spaced arms 15 is integrally formed with the body member 10 and the outer end of the arms 15 are joined as at 16 to form a passageway 17 in which a stakable compression screw 18 is positioned. A deflector 19 is secured to the outer end of the compression screw 18. The compression screw 18 extends inwardly of the junction 16 of the arms 15 and it lies on the axial center line of the fluid delivery passageway 12 of the sprinkler. The inner end of the screw 18 is pointed for registry with a depression in a substantially horizontal portion 20 of an inverted generally L-shaped lever 21. A straight substantially vertically positioned strut 22 is positioned with one of its ends in a depression in the closure cap 13 and its opposite end against the inner surface of the substantially horizontal portion 20 of the lever 21 and between a pair of spaced projections thereon. The strut 22 is positioned substantially on the axial center line of said fluid delivery passageway 12. The strut 22 has a pair of oppositely disposed sidewardly extending apertured arms 23 formed integrally therewith and inwardly of its upper and lower ends and the substantially vertical portion of the lever 21 extends into the area between the arms 23.

Figure 4:
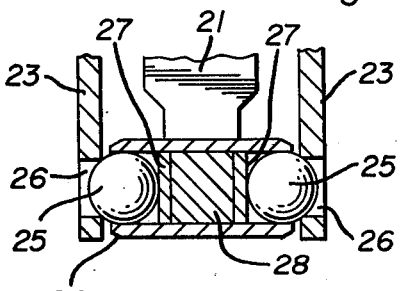
FIG. 4 is an enlarged detail on line 4—4 of FIG. 3.

By referring now to FIGS. 1 and 4 of the drawings, it will be seen that a fusible element including a tubular body 24 is positioned between the apertured arms 23 so that a pair of spheres 25 positioned partially within the ends of the tubular body 24 are also partially engaged in oppositely disposed apertures 26 in the outer portions of the arms 23. A pair of discs 27 are located one on either side of a pellet of fusible material 28 with the discs 27 engaging the innermost surfaces of the spheres 25. The pellet 28 is formed of eutectic fusible alloy as known in the art, which may have various known melting temperatures as desired.

By referring to FIG. 4 of the drawings in particular it will be observed that the outermost ends of the tubular body 24 are crimped slightly so as to cage the spheres 25 therein which is useful during assembly of the sprinkler as disclosed herein. The outer surfaces of the opposite ends of the tubular body 24 are tapered slightly.

By referring now to FIG. 5 of the drawings, a sectional elevation similar to FIG. 3 may be seen illustrating the sprinkler of the invention as in opening responsive to the fusible element 24 reaching the predetermined desired temperature, for example 165° F. In FIG. 5 of the drawings it will be seen that the fluid pressure normally present in the fluid delivery passageway 12 has been released by the action of the fusible element which permits the discs 27 and the spheres 25 to move inwardly of the tubular body 24 so that the fusible element can move outwardly of the openings 26 in the apertured arms 23 of the strut 22 responsive to the pressure urging such action as occasioned by the tension on the substantially horizontal portion 20 of the lever 21 and assisted by the pressure of the fluid in the fluid delivery passageway 12.

The gasket 14, cap 13, strut 22 and lever 21 as well as the fusible element in the tubular body 24 all move away from the sprinkler and permit the fluid discharged through the fluid passageway 12 to strike the deflector 19 and be directed in a desired pattern.

It will be seen that the arrangement of the fusible element in its horizontally disposed tubular body 24 normally positioned between the apertures 26 in the outer portions of the apertured arms 23 of the strut 22 of the device with only limited contact therewith enables the fusible material of the pellet 28 to respond quickly to the air temperatures exteriorly thereof so that the sprinkler responds more rapidly upon being subjected to the predetermined operating temperature than has heretofore been the case. It will be seen that upon fusing of the material of the pellet 28, either or both of the spheres 25 and the discs 27 may move toward one another and such movement of either sphere 25 relative to the apertured arms 23 results in the fast opening of the sprinkler.

It will thus be seen that a sprinkler has been disclosed which is relatively simple in construction and assembly and which may be formed of a relatively small size and retain complete effectiveness. For example a typical sprinkler formed in accordance with this invention has an overall height of two and three-eighths inches and an overall width at its widest part of only one and three-eights inches and it locates its heat sensitive fusible element in a manner that substantially isolates it with respect to the remainder of the sprinkler so as to assure rapid operation at an indicated air temperature.

Although but one embodiment of the present invention has been illustrated and described, it will be apparent to those skilled in the art that various changes and modofications may be made therein without departing from the spirit of the invention and having thus described my invention what I claim is:

1. A sprinkler comprising a body member having a fluid delivery passageway therethrough, oppositely disposed arms on said body member forming a frame outwardly of said fluid passageway and joined at their outer ends, a compression fitting positioned through a secondary passageway in said joined arms on the axial center line of said fluid delivery passageway, a deflector on said compression fitting and a closure on said fluid delivery passageway, an assembly comprising an inverted L-shaped lever having a substantially horizontal portion and a substantially vertical portion and a straight strut, said assembly positioned between and in engagement with said compression fitting and closure and normally retaining said closure on said fluid delivery passageway, said straight strut being positioned substantially on said axial center line, a pair of spaced oppositely disposed sidewardly extending apertured arms on said straight strut and a horizontally disposed fusible material retaining means positioned between said apertured arms and partially engaged in the apertures therein, said substantially vertical portion of said inverted L-shaped lever being normally positioned between said apertured arms and spaced therefrom and between said straight strut and said fusible material retaining means and in engagement with said fusible material retaining means, said fusible material retaining means normally preventing relative motion of said lever with respect to said strut in said assembly and acting to free said lever from said strut upon attainment of a predetermined temperature.

2. The sprinkler set forth in claim 1 and wherein said fusible retaining means comprises a tubular member open at its opposite ends, a pellet of fusible material positioned inwardly of said ends, a pair of discs positioned one on either side of said pellet and arranged to permit said fusible material of said pellet to flow around the peripheral edges thereof when fused, a pair of spheres, each of which is positioned partially within the opposite ends of said tubular member and partially within said apertures in said apertured arms.

3. The sprinkler set forth in claim 2 and wherein the apertures in said arms are defined by right angular walls with respect to said arms so as to form very narrow areas of engagement with said spheres.

4. The sprinkler set forth in claim 2 and wherein the opposite ends of said tubular member of sid fusible retaining means are deformed inwardly sufficiently to cage said spheres partially therein.

5. The sprinkler set forth in claim 1 and wherein said portion of said lever normally positioned between said apertured arms and between said strut and said fusible retaining means is of relatively smaller size than the remainder of said lever so as to reduce the area of contact between said lever and said fusible retaining means.

6. The sprinkler set forth in claim 1 wherein the horizontally disposed fusible retaining means is arranged for minimal contact with said lever and said apertured arms so as to prevent dissipation of heat through said contact.

7. The sprinkler set forth in claim 1 and wherein said sidewardly extending apertured arms on said strut extend outwardly therefrom sufficiently to locate the apertures therein beyond said closure so that heated air moving past said sprinkler directly engages said fusible retaining means.

* * * * *

Notice of Adverse Decision in Interference

In Interference No. 99,811, involving Patent No. 4,029,150, E. M. Goodsell, Jr., SPRINKLER, final judgment adverse to the patentee was rendered Oct. 8, 1980, as to claims 1, 2, 4–7.

[*Official Gazette November 3, 1981.*]